US007300248B2

(12) United States Patent
Wang

(10) Patent No.: US 7,300,248 B2
(45) Date of Patent: Nov. 27, 2007

(54) CEILING FAN ASSEMBLY

(76) Inventor: Cliff Wang, No. 122, Teh-Gi Street, South District, Taichung (TW)

( * ) Notice: Subject to any disclaimer, the term of this patent is extended or adjusted under 35 U.S.C. 154(b) by 225 days.

(21) Appl. No.: 11/130,685

(22) Filed: May 17, 2005

(65) Prior Publication Data

US 2006/0278766 A1 Dec. 14, 2006

(51) Int. Cl.
*F04D 29/64* (2006.01)

(52) U.S. Cl. ..... 416/5; 416/244 R; 248/343

(58) Field of Classification Search ..... 416/244 R, 416/5

See application file for complete search history.

(56) References Cited

U.S. PATENT DOCUMENTS 4,754,383 A * 6/1988 Klaus ..... 362/363
5,988,580 A * 11/1999 Bucher et al. ..... 416/5
6,171,061 B1 * 1/2001 Hsu ..... 416/244 R
6,171,062 B1 * 1/2001 Bucher et al. ..... 416/244 R
6,200,099 B1 * 3/2001 Liao ..... 416/244 R
2003/0189151 A1 * 10/2003 Hsing ..... 248/345
2003/0210983 A1 * 11/2003 Yung ..... 416/244 R
2005/0051691 A1 * 3/2005 Liang ..... 248/343

* cited by examiner

*Primary Examiner*—Richard Edgar
(74) *Attorney, Agent, or Firm*—Parsons & Goltry; Michael W. Goltry; Robert A. Parsons

(57) ABSTRACT

A ceiling fan assembly includes a hanger bracket secured to a conventional overhead support member and a fan motor depending from the hanger bracket. A housing encapsulating the fan motor and the hanger is detachably secured by a detent engagement means. An element of the detent engagement means is integral with the hanger bracket and a complemental element of the detent engagement means is integral with the housing. When engaged, the housing obscured the detent engagement means.

10 Claims, 6 Drawing Sheets

FIG.4
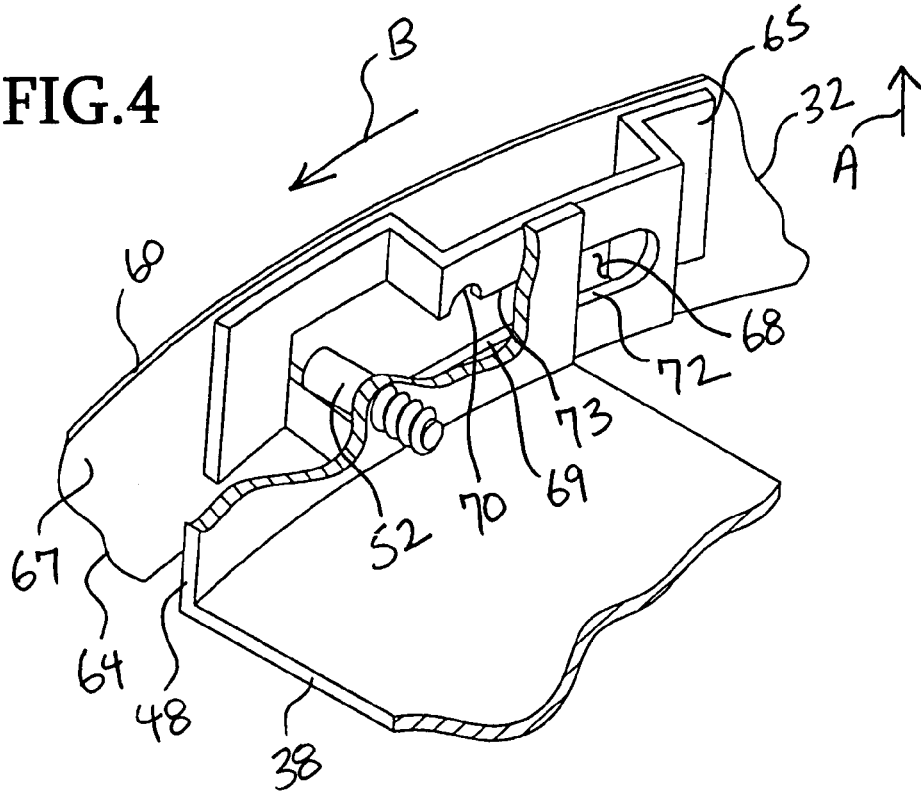
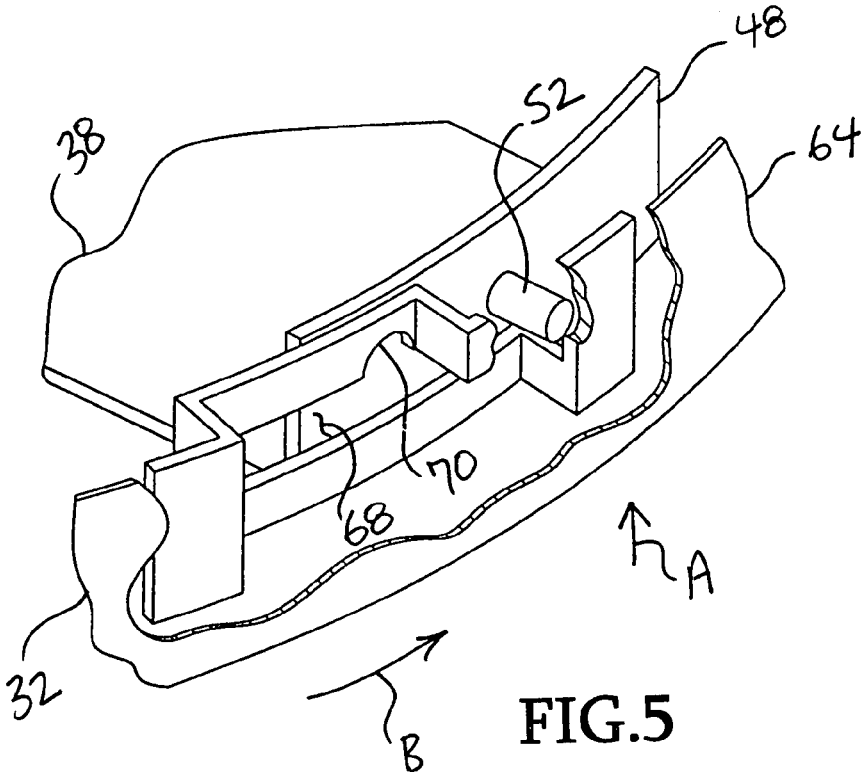
FIG.5

FIG.6
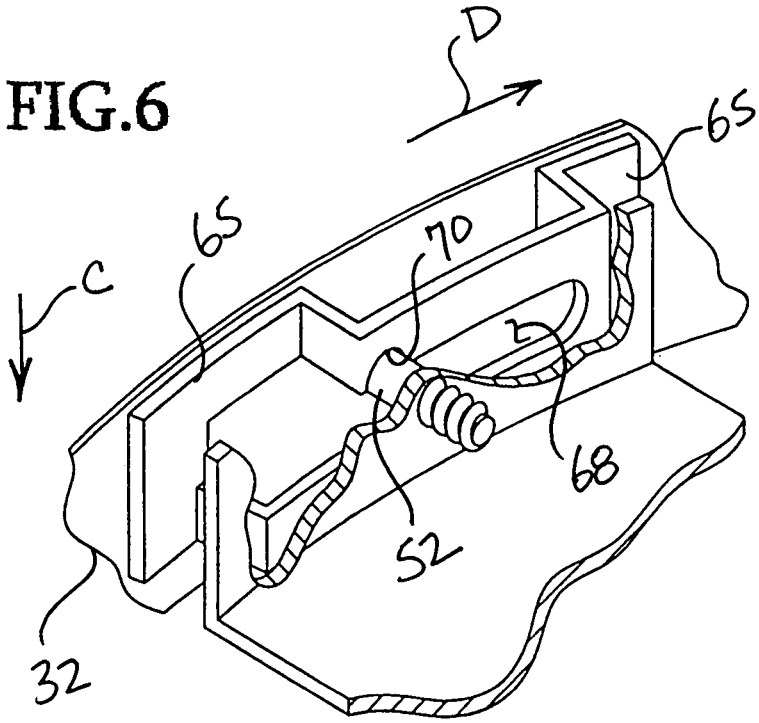
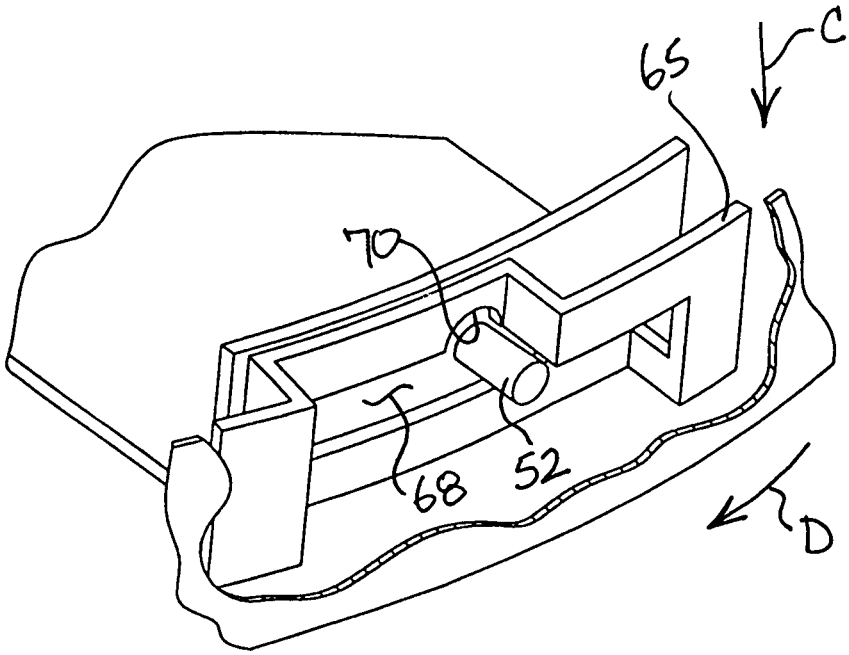
FIG.7

CEILING FAN ASSEMBLY

BACKGROUND

1. Field of the Invention

This invention relates to ceiling fans.

More particularly, the present invention relates to ceiling fans of the type having a hanger assembly supporting a motor and depending from an overhead support device.

In a further and more specific aspect, the instant invention concerns a housing for obscuring a fan motor and hanger assembly and enhancing the aesthetic appearance.

2. The Prior Art

The prior art is replete with various configurations of overhead air circulation devices commonly referred to as ceiling fans. Typically, a ceiling fan includes a support bracket affixed to an overhead support member such as an electrical junction box. An electric motor, having a hub which is rotatable about a vertical axis, is affixed to a down shaft which is suspended from the support bracket. A plurality of blade irons, each supporting an end of a radially extending blade, are secured to the hub. Frequently, a canopy encloses the mounting bracket and the upper end of the down shaft.

Conventional, commercially available ceiling fans are generally lacking aesthetic value. For example, the rather large motor depending from a slender down shaft projects an unbalanced appearance. The exposed heads of the screws, usually employed to secure the canopy to the mounting bracket, detract from the visual perception. Other detractions, such as the required mechanical configuration of the motor, are notable.

It would be highly advantageous, therefore, to aesthetically obscure from view various unsightly mechanical aspects of prior art ceiling fans.

SUMMARY OF THE INVENTION

The foregoing and other objects and advantages of the instant invention are at least partially realized in a ceiling fan assembly comprising a hanger bracket secured to an overhead support member and a fan motor depending from the hanger bracket and having a rotatably driven hub. A plurality of blade irons, each having a radially extending fan blade secure thereto, are affixed to the hub. Next provided is a housing secured to the hanger bracket and encapsulating the fan motor and the hanger bracket.

The housing is securable to the hanger bracket in response to rotation of the housing in a first direction relative to the hanger bracket. The housing is removable from the hanger bracket in response to rotation in a second direction opposite said first direction relative said hanger bracket.

In accordance with the principles of the present invention there is provided a first detent engagement pair interacting between the housing and the hanger bracket for detachable securement of the housing to the hanger bracket. Also provided is a second detent engagement pair opposing the first detent engagement pair of detachable securement of the housing to the hanger bracket.

The first detent engagement pair includes an element of a detent engagement pair carried by one of the hanger bracket and the housing and a complemental element of the detent engagement pair carried by one of the hanger bracket and the housing. The second detent engagement pair includes an element of a detent engagement pair carried by on of the hanger bracket and the housing and a complemental element of the detent engagement pair carried by one of the hanger bracket and the housing.

More specifically, the element of the first detent engagement pair includes a first pin extending radially from the hanger bracket and the complemental element of the first engagement pair includes a recess carried by the housing for matingly receiving the first pin. The element of the second detent engagement pair includes a second pin extending radially for the hanger bracket in opposition to the first pin. The complemental element of the second engagement pair includes a second recess carried by the housing for matingly receiving the second pin.

The first recess is integral with a first circumferentially extending slot sized to receive the first pin therein. Complementary, the second recess is integral with a second circumferentially extending slot sized to receive the second pin therein.

A first ramp is associated with the first circumferentially extending slot for initially receiving the first pin and guiding the pin into the first slot. Similarly, a second ramp is associated with the second circumferentially extending slot for initially receiving the second pin and guiding the pin into the second slot. The pin is urged into the first recess and the second join is urged into the second recess in response to downward gravitational pull upon the housing.

The housing includes a terminal portion adjacent an upper edge for obscuring the first and the second detent engagement pairs. The hanger bracket includes a first member secured to the overhead support member and a second member detachably securable to the first member.

BRIEF DESCRIPTION OF THE DRAWINGS

The objects and advantages of the instant invention will become readily apparent to those skilled in the art from the following detailed description of a preferred embodiment thereof taken in conjunction with the drawings, in which:

FIG. 4 is an enlarged fragmentary perspective illustration of the engagement members seen in FIG. 2;

FIG. 5 is an illustration corresponding to illustration of FIG. 4, when viewed from the opposite side;

FIG. 6 is an enlarged fragmentary perspective illustration of the engagement members seen in FIG. 3;

FIG. 7 is an illustration corresponding to the illustration of FIG. 6, when viewed from the opposite side.

DETAILED DESCRIPTION OF A PREFERRED EMBODIMENT

Figure 1:
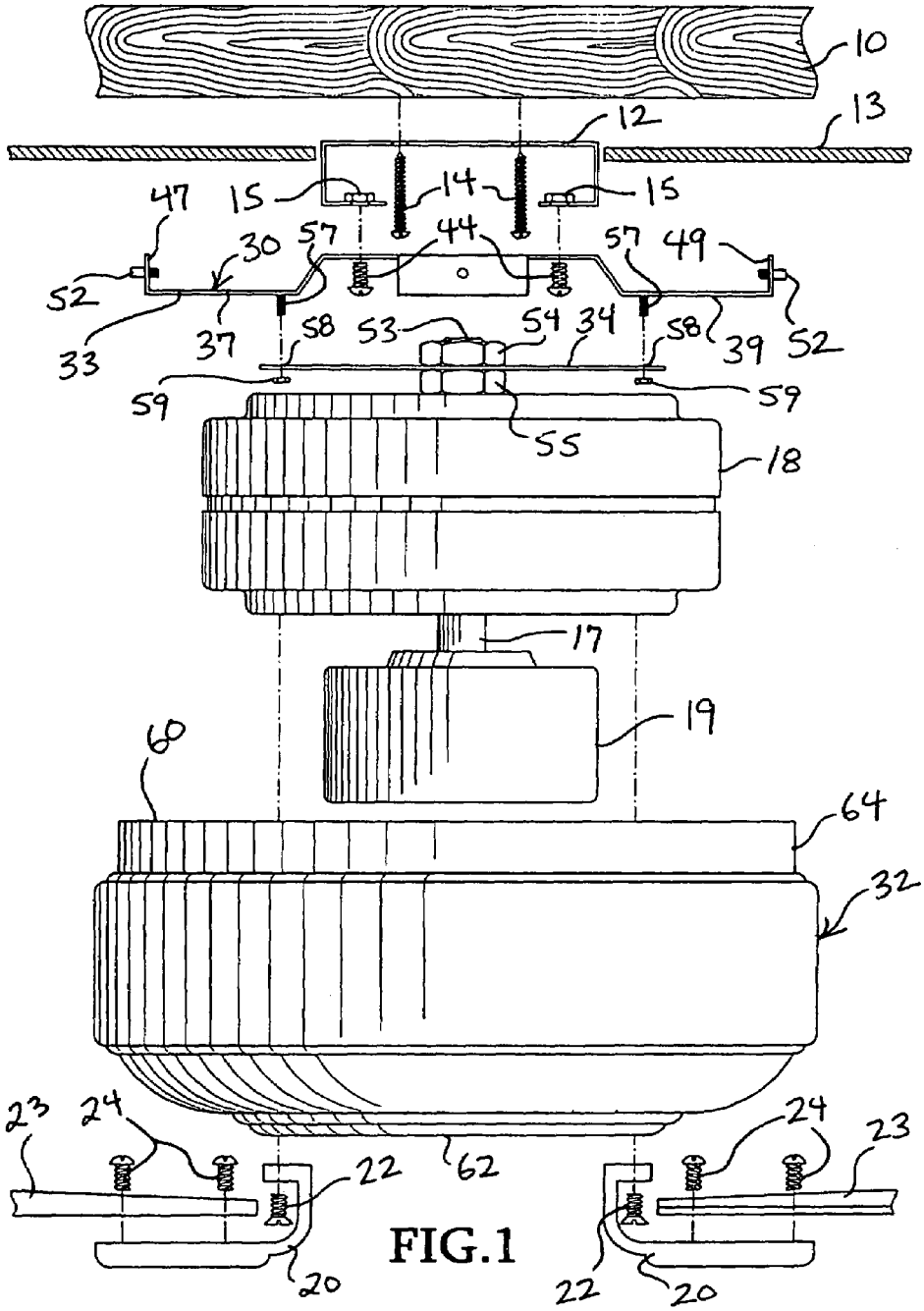
FIG. 1 is an exploded side elevation view of a ceiling fan assembly embodying the principles of the instant invention.

Turning now to the drawings, in which like reference characters indicate corresponding elements throughout the several views, attention is first directed to FIG. 1, in which is illustrated a rafter 10, electrical junction box 12 and paneling 13. Electrical junction box 12 is secured to rafter 10 by wood screws 14. Machine screw nuts 15 are brazed or otherwise secured to junction box 12. The foregoing is intended to be representative of conventional ceiling structure which functions as an overhead support member for a ceiling fan assembly. Other details and variations will readily occur to those skilled in the art.

Further, as will be appreciated by those skilled in the art, the ceiling fan assembly of the present invention incorporates a down shaft 17 which depends from fan motor 18 and supports switch box 19. Switch box 19 is ordinarily employed to house switches, which control direction of rotation and variable speed of rotation of fan motor 18. Lights are also frequently supported by switch box 19.

Although not specifically illustrated, but as will be apparent to those skilled in the art, fan motor includes a rotatably driven hub. A plurality of blade irons 20 are secured to hub by as by screws 22. In accordance with conventional practice, a fan blade 23 is secured to each blade iron 20 by means of screws 24 which extend through the fan blade and threadedly engage the respective blade iron. It will be appreciated that each fan blade 23 extends radially from fan motor 18 and is pitched for engaging and distributing air.

Improvements to the prior art, as provided by the present invention, include a hanger bracket, generally designated by the reference character 30 and a housing, generally designated by the reference character 32.

Hanger bracket 30 includes first component 33 and second component 34. As seen with additional reference to FIG. 2, first component 33 includes hub 35 which functions as a confluence for arms 37, 38, 39 and 40. Slots 42 and 43 extending through hub 35 accommodate machine screws 44, which extend through hub 35 and threadedly engage nuts 15 carried within electrical junction box 12. Accordingly, first component 33 is detachably securable to the overhead support member. Hub 35 also includes central opening 45, the purpose of which will be described presently.

The several arms 37, 38, 39 and 40 extend radially from hub 35 and are spaced at mutual ninety degree angles. Accordingly, arm 37 is diametrically opposed to arm 39. Similarly, arm 38 is diametrically opposed to arm 40. Arm 37 terminates with upturned flange 47. Arm 38 terminates with upturned flange 48. Arm 39 terminates with upturned flange 49. Arm 40 terminates with upturned flange 50. Taken together, the several flanges 47, 48, 49 and 50 define a cylinder of which further detail will be explained presently. A pin 52 extends radially outward from each said flange.

Figure 8:
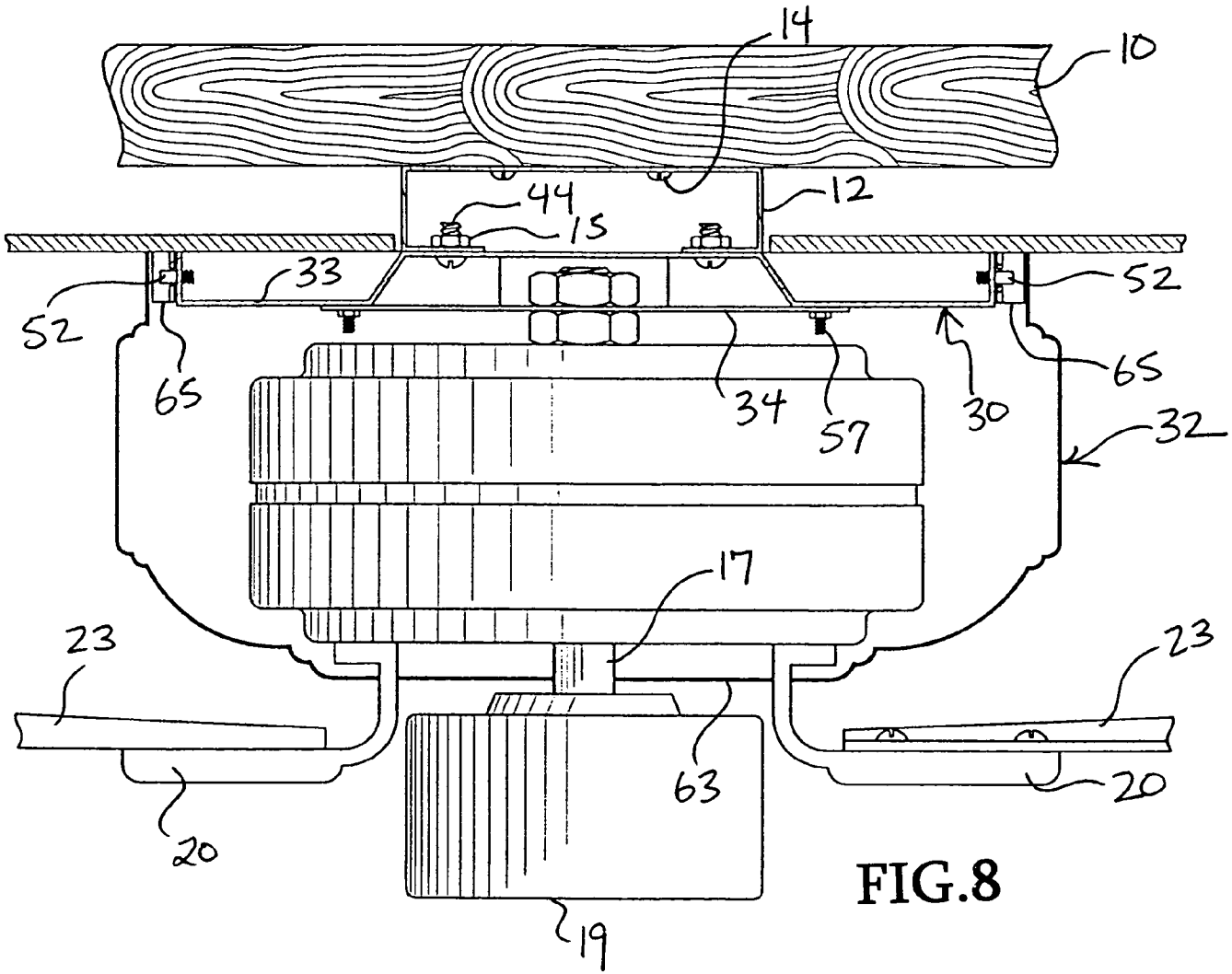
FIG. 8 is a view generally similar to the view of FIG. 1 and illustrating the components of the ceiling fan assembly as it would appear in the assembled configuration.

With reference to FIG. 1, it is seen that the terminal portion of down shaft 17 adjacent upper end 53 is provided with an external thread for engagement with upper nut 54 and lower nut 55. Second component 34 of hanger bracket 30 is captivated between upper nut 54 and lower nut 55. Threaded studs 57 depends from first component 33 of hanger bracket 30. The studs 57 are received through openings 58 in second component 34. Thereafter, a nut 59 is secured to each stud 57 for detachable engagement of second component 34 to first component 33. The upper end 53 of down shaft 17 and upper nut 54 are received within central opening 45 in first component 33. The assembled hanger bracket as it would appear when secured to the overhead support member and having the fan motor depending there from is illustrated in FIG. 8.

Figure 2:
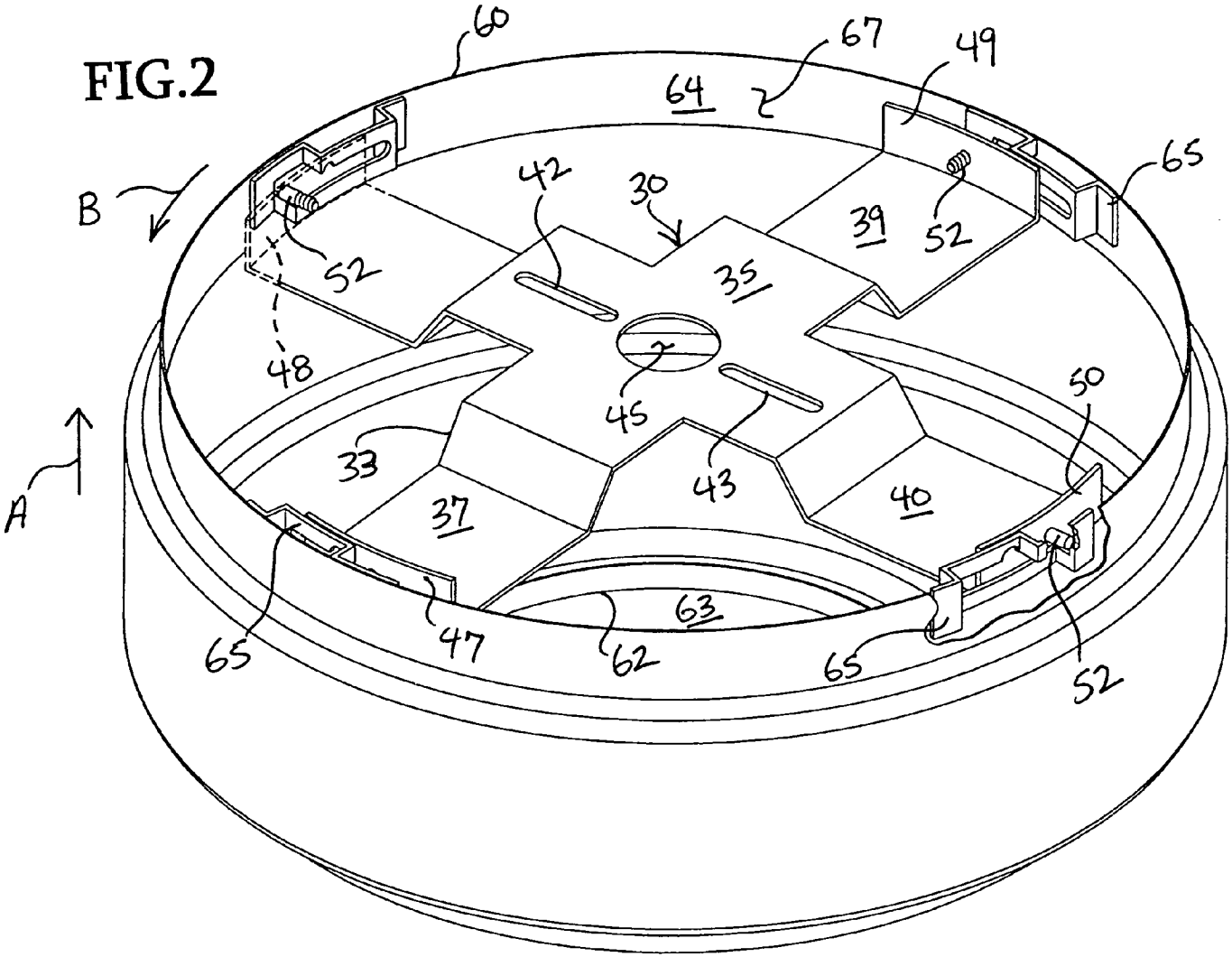
FIG. 2 is a perspective view of a hanger bracket and a housing of the present invention, especially as seen during an initial stage of engagement.

Housing 32, as illustrated in FIG. 1 and FIG. 2 is a hollow vessel having upper edge 60 and lower edge 62. Opening 63 is defined by lower edge 62. Upper terminal portion 64 adjacent upper edge 60 is cylindrical. The cylinder defined by the previously described upturned flanges 47, 48, 49 and 50 is smaller than and congruent with cylindrical upper terminal portion 64 of housing 32.

A plurality of brackets 65, as illustrated in FIG. 2, are brazed, soldered or otherwise secured to the inner sidewall 67 of upper terminal portion 64 of housing 32 at ninety degree intervals. As more clearly illustrated in FIG. 4, each bracket 65 includes a circumferentially extending blind slot 68, ramp 69 and recess 70. Ramp 68 is contiguous with lower edge 72 of slot 68. Recess 70 is formed into the upper edge 73 of slot 68. Slot 68 is sized to receive pin 52 therein. Recess 70 is sized to engage pin 52.

The attachment of housing 32 to hanger bracket 30 will now be described with initial reference to FIG. 2, FIG. 4 and FIG. 5. In response to upward force applied to housing 32, as indicated by arrowed line A, a ramp 69 is abutted against a respective pin 52. The respective flange is received in juxtaposition with a bracket 65. Arm 38 and upstanding flange 48 were chosen for purposes of illustration in FIGS. 4 and 5.

Maintaining the upward force indicated by the arrowed line A, housing 32 is rotated in the direction indicated by the arcuate arrowed line B. In response thereto each pin 52 is entered into a respective slot 68. The rotation continues until each pin 52 abuts the blind end of the respective slot 68.

Figure 3:
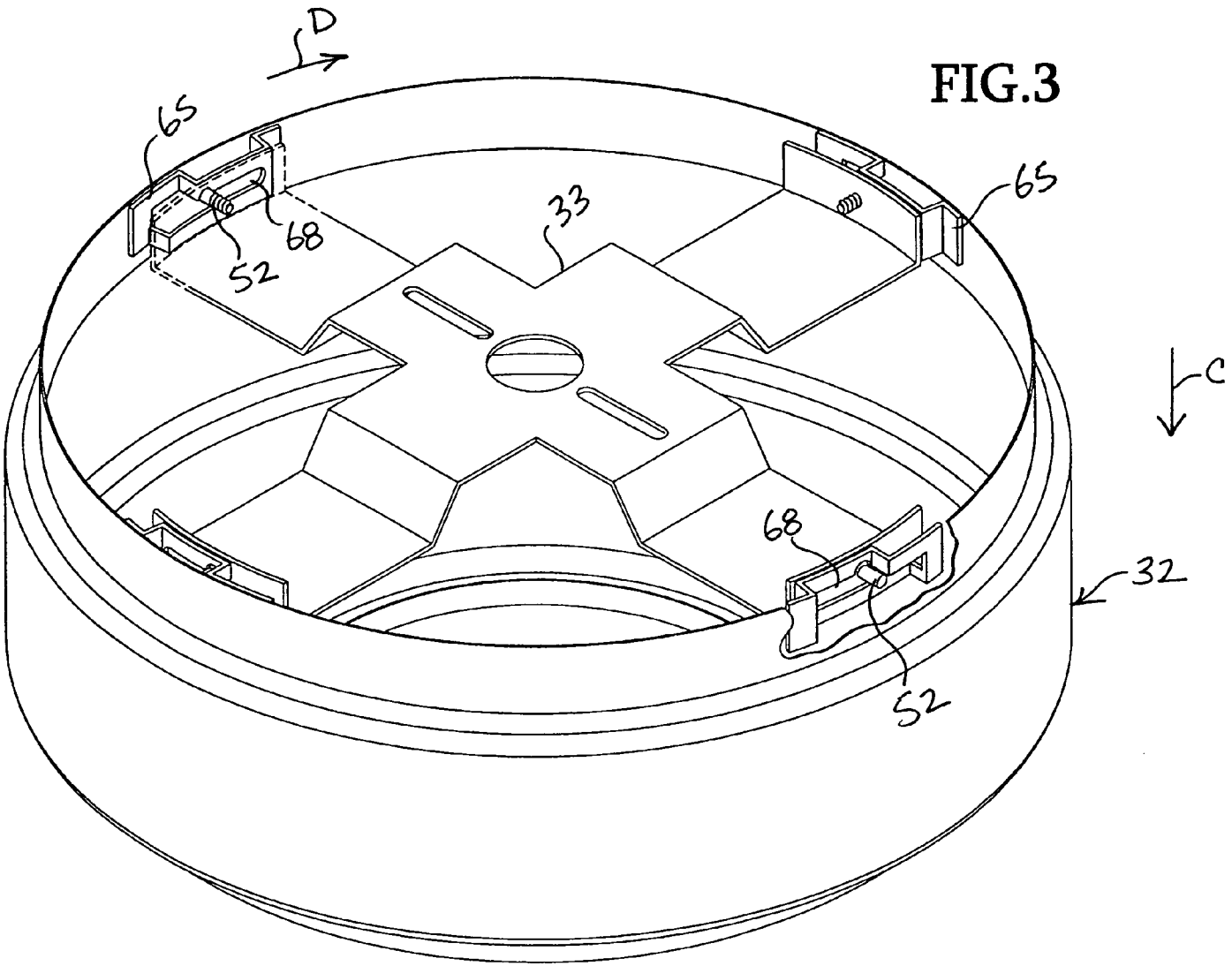
FIG. 3 is a perspective view similar to the view of FIG. 2, as the hanger bracket and housing would appear in a final stage of attachment.

Subsequently, the upward force in the direction of arrow line A is discontinued. The force of gravity will then dominate and pull housing 32 downward in the direction of arrowed line C as noted in FIG. 3, FIG. 6 and FIG. 7. Housing 32 is then rotated in the opposite direction as indicated by the arcuate arrowed line D. Rotation is continued until each pin 52 aligns with a respective recess 70. In response to the force applied in the direction of arrowed line C, each recess 70 will receive the respective pin 52.

Attention is now directed to FIG. 8, in which it is seen that the several pins 52 and the associated bracket 65 are arranged in opposed pairs which retard lateral movement of the instant ceiling fan assembly. Further, each pin 52 and respective recess 70 function as element and complemental element of a detent engagement pair for detachably securing housing 32 to hanger bracket 30. Tn this regard, it is apparent that in response to movements in directions opposite the movements described herein before housing 32 can be readily removed from hanger bracket 30. Housing 32 encapsulates fan motor 18 and hanger bracket 30 to enhance the aesthetics of the assembly. It is also noted that upper terminal portion 64 of housing 32 obscures the detent engagement pairs.

The present invention is described above with reference to a preferred embodiment. However, those skilled in the art will recognize that changes and modifications may be made in the described embodiment without departing from the nature and scope of the present invention. For instance, while first component 33 of hanger bracket 30 was described as a hub having radially extending arms, it will be appreciated that first component 33 may be in the form of disk with an upturned edge. It is also contemplated that the attachment of housing 32 to hanger bracket may include only one pair of opposed detent engagement means.

Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. In a ceiling fan assembly including an overhead support member, a hanger bracket secured to said support member and a fan motor depending from said hanger bracket, improvements therein comprising:

a housing encapsulating said hanger bracket and said fan motor;

a first detent engagement pair detachably securing said housing to said hanger bracket;

a second detent engagement pair opposing said first detent engagement pair detachably securing said housing to said hanger bracket;

each said detent engagement pair includes an element of said engagement pair carried by said mounting bracket and a complemental element of said detent engagement carried by said housing;

said element of said detent engagement pair includes a pin projecting radially from said hanger bracket;

said complemental element of said detent engagement pair includes a recess for matingly receiving said pin; and each said recess is integral with a circumferentially extending slot sized to receive the respective pin therein.

2. The improvements of claim 1, further including a ramp associated with each said slot for initially receiving the respective pin and guiding said pin into said slot.

3. The improvements of claim 1, wherein said housing includes a terminal portion adjacent an upper edge thereof for obscuring said first and said second detent engagement pairs when said housing is affixed to said mounting bracket.

4. The improvements of claim 1, wherein said hanger bracket includes:

a first component securable to said overhead support member; and a second component having said motor secured thereto and detachably securable to said first member.

5. The improvements of claim 1, wherein a switch box and a plurality of blade irons depend from said motor and said housing includes an opening for receiving said switch box and said blade irons there through.

6. A ceiling fan assembly comprising:

a hanger bracket secured to a selected overhead support member;

a fan motor depending from said hanger bracket and having a rotatably driven hub;

a plurality of blade irons affixed to said hub and depending from said motor;

a fan blade affixed to and extending radially from each of said plurality of blade irons;

a housing secured to said hanger bracket and encapsulating said fan motor and said hanger bracket;

said housing securable to said hanger bracket in response to rotation of said housing in a first direction relative to said hanger bracket, and said housing removable from said hanger bracket in response to rotation of said housing in a second direction relative to said hanger bracket;

a first detent engagement pair interacting between said housing and said hanger bracket detachably securing said housing to said hanger bracket;

a second detent engagement pair opposing said first detent engagement pair detachably securing said housing to said hanger bracket;

said first detent engagement pair includes an element of a detent engagement pair carried by one of said hanger bracket and said housing and a complemental element of said detent engagement pair carried by one of said hanger bracket and said housing;

said second detent engagement pair includes an element of a detent engagement pair carried by one of said hanger bracket and said housing and a complemental element of said detent engagement pair carried by one of said hanger bracket and said housing;

said element of said first detent engagement pair includes a first pin extending radially from said hanger bracket and said complemental element of said first engagement pair includes a first recess carried by said housing for matingly receiving said first pin;

said element of said second detent engagement pair includes a second pin extending radially from said hanger bracket in opposition to first pin and said complemental element of said second detent engagement pair includes a second recess carried by said housing for matingly receiving said pin;

said first recess integral with a first circumferentially extending slot sized to receive said first pin therein; and said second recess integral with a second circumferentially extending slot sized to receive said second pin therein.

7. The ceiling fan assembly of claim 6, further including:

a first ramp associated with said first circumferentially extending slot for initially receiving the said first pin and guiding the pin into said first slot; and a second ramp associated with said second circumferentially extending slot for initially receiving the said second pin and guiding the pin into said second slot.

8. The ceiling fan assembly of claim 6, wherein said first pin is urged into mating engagement with said first recess and said second pin is urged into mating engagement with said second recess in response to downward gravitational pull upon said housing.

9. The ceiling fan assembly of claim 6, wherein said housing includes a terminal portion adjacent and upper edge thereof for obscuring said first detent engagement pair and said second detent engagement pair.

10. The ceiling fan assembly of claim 6, wherein said hanger bracket includes:

a first component secured to said overhead support member; and a second component having said motor secured thereto and detachably securable to said first member.

* * * * *